United States Patent [19]

Marforio

[11] 4,038,933

[45] Aug. 2, 1977

[54] DEVICE FOR RETAINING A CHAIN OF STITCHES IN A SEWING MACHINE

[75] Inventor: Nerino Marforio, Milan, Italy

[73] Assignee: Rockwell-Rimoldi S.p.A., Milan, Italy

[21] Appl. No.: 716,118

[22] Filed: Aug. 20, 1976

[30] Foreign Application Priority Data

Sept. 11, 1975 Italy ..... 27122/75

[51] Int. Cl.[2] ..... D05B 65/00

[52] U.S. Cl. ..... 112/288; 112/253; 112/DIG. 1

[58] Field of Search ..... 112/197, 252, DIG. 1, 112/260, 253

[56] References Cited

U.S. PATENT DOCUMENTS

| | | | |
|---|---|---|---|
| 3,143,987 | 8/1964 | Daniel et al. | 112/252 |
| 3,379,151 | 4/1968 | Tiemann | 112/252 |
| 3,511,202 | 5/1970 | Strauss et al. | 112/252 |
| 3,581,716 | 6/1971 | Teed | 112/252 |
| 3,624,734 | 11/1971 | Schips | 112/252 |
| 3,698,336 | 10/1972 | Launer | 112/252 |
| 3,922,983 | 12/1975 | Schips et al. | 112/252 |

*Primary Examiner*—George H. Krizmanich

[57] ABSTRACT

A sewing machine having a needle plate with an integrally formed tongue on which a chain of stitches is formed. The tongue includes an internal bore pneumatically connected to a vacuum unit which is selectively activated to draw a chain of stitches severed from the previously seamed workpiece into the bore. The suction created by the vacuum is sufficient to hold the chain of stitches and permit their release during advance of the next workpiece so as to be incorporated in the seam formed therein.

2 Claims, 2 Drawing Figures

DEVICE FOR RETAINING A CHAIN OF STITCHES IN A SEWING MACHINE

BACKGROUND OF THE INVENTION

The present invention relates to a pneumatic device for retaining the chain of stitches at the commencement of stitching.

In the case of sewing machines which produce stitching on a series of pieces of fabric, for example, an overcasting operation, the machine is designed to continue this operation in the free space between a sewn piece of fabric and the succeeding piece of fabric and these pieces of fabric are adapted to be separated from one another by suitable cutting means as soon as they move beyond the presser foot of the sewing machine.

As a result, a section of the chain of stitches remains on the leading edge of the finished piece. This section must be turned back in the stitching formed in the piece itself so as not to spoil the appearance of the finished workpiece and to prevent the stitches from coming undome. It is already known in the art to fold back the afore-mentioned chain section within the stitching being produced on a piece of fabric but the devices for effecting this operation all have the disadvantage of considerably reducing visibility in the sewing zone; these known devices necessitate additional elements which are added to those normally provided in these zones on sewing machines to grip the free end of the chain projecting from the tongue of the needle plate so as to carry it in front of the needle in order to incorporate it in the new stitching being produced.

SUMMARY OF THE INVENTION

The object of the present invention is to eliminate these disadvantages and, more particularly, to considerably simplify the afore-mentioned device by using those elements which are already provided on the sewing machine in the sewing zone and not adding additional elements.

The solution employed to achieve this end consists of a pneumatic device for retaining the chain of stitches at the commencement of stitching. In this device the tongue on which the chain of stitches is formed is provided with an internal cavity which is terminated in correspondence with the free end of said tongue. This cavity is adapted to draw in the free chain section at the beginning of each stitching operation so as to incorporate this portion in the successive stitches which are formed in a new piece of fabric. The provision of a device having this structure offers the advantage of being able to turn back the free chain section in the optimum manner, and stretching it out completely within the stitches. This is made possible due to the fact that the stitches are formed on the outside of the element within which the chain section is drawn.

In addition, the device according to the invention has the advantage of not obstructing the sewing zone which thus remains readily accessible to the operator's hands and offers unrestricted visibility so that the pieces of fabric to be sewn can be correctly positioned.

Other objects features and advantages of the present invention will be made apparent in the course of the following description thereof which is provided with reference to the accompanying drawings in which:

DESCRIPTION OF THE PREFERRED EMBODIMENT

Figure 1:
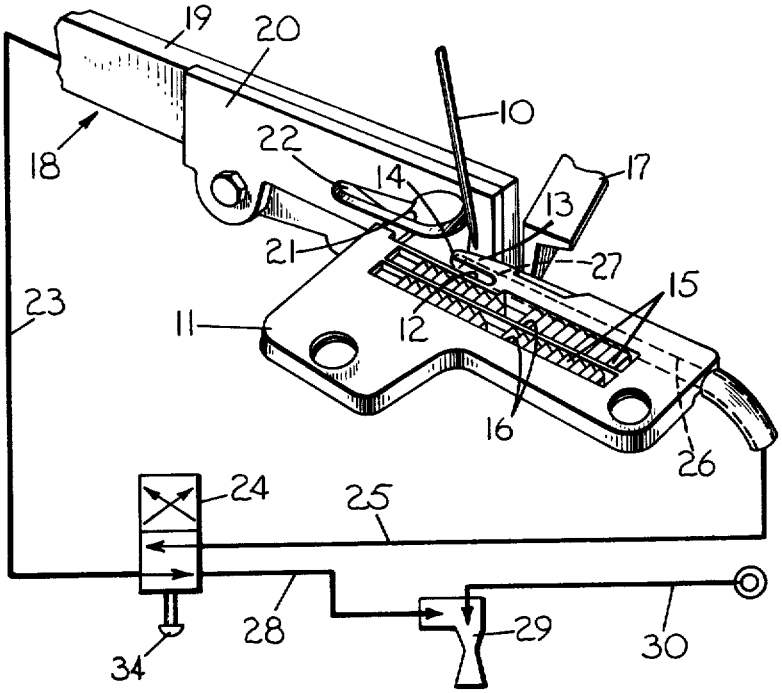
FIG. 1 is a perspective view of the device according to the invention.

Referring now to FIG. 1 which shows a portion of a sewing machine, and more particularly, a machine for producing an overcasting stitch. This machine consists generally of a casing (not shown) within which are housed the normal elements for sewing and advancing pieces of fabric.

These sewing elements include a needle 10 disposed above a needle plate 11, on which the piece of fabric to be sewn is placed.

This plate has a slot 12 in which the needle 10 is inserted so as to pass completely through the piece of fabric and reach the other components (not shown) of the above-mentioned sewing elements which include the well known upper and lower hooks.

The slot 12 defines a tongue 13 formed integral with the needle plate 13 on which the stitches are formed as a result of the linking together of the normal threads held in the needle and the hooks.

This tongue projects from the needle plate and its free end 14 extends in the same direction as that in which the piece of fabric being sewn is advanced.

The forward movement of the piece of fabric is accomplished by the afore-mentioned advancement elements comprising a conventional feed dog 15 which periodically projects upwardly in a known manner from the corresponding slot 16 provided in the needle plate 11.

A cutting blade 17 is positioned adjacent to the needle 10 and is adapted to trim the edge of the piece of fabric being sewn.

A conventional chain cutting device 18 is mounted in close proximity with the tongue 13 and extends in a direction parallel to the latter. This chain cutting device is pneumatically controlled and includes a tube 19 on which a plate 20 having an aperture 21 is attached. The chain of stitches which is formed on the afore-mentioned tongue 13 is drawn through the aperture 21 and is then cut in a conventional manner by a blade 22.

The tube 19 of the chain cutting device 18 is conneted to a conduit 23 and a switching means consisting, for example, of a switching valve 24. Additionally this switching valve 24 is interconnected with a channel or bore 26 provided internally of the needle plate 11 by means of a conduit 25.

The longitudinal channel 26 extends the entire length of the needle plate 11 and also that of the tongue 13 and within the latter defines an inner cavity 27.

The switching valve 24 is also connected by means of a conduit 28 to a vacuum unit 29 which is supplied by a conventional pneumatic feed line 30.

Figure 2:
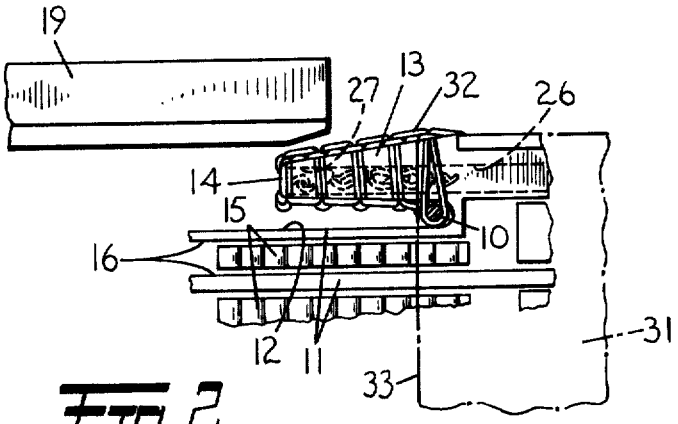
FIG. 2 shows an enlarged detail taken from FIG. 1.

At the beginning of each stitching operation, a piece of fabric 31 (FIG. 2) to be sewn is positioned beneath the presser foot of the sewing machine while the latter is already in operation, and a chain of stitches 32 is formed on the tongue 13 until the leading edge 33 of said piece of fabric comes beneath the needle 10.

To prevent a section of chain from remaining on the leading edge 33, at the beginning of each stitching operation, the operator applies pressure to a push button 34 of the switching valve 24 so as to render the chain cutting device 18 inoperative.

As a result ov the pressure applied to the push button 34, the switching valve directly connects the vacuum unit 29 to the cavity 27 of the tongue 13 by way of the conduit 25 and the longitudinal channel 26, thus producing suction in the cavity 27 so as to draw the chain of stitches 32 therein.

As a result, the chain which is formed on the tongue enters the cavity 27 and is sewn into the succssive stitches which are then formed. When the leading edge 33 of the piece of fabric encounters the end 14 of the tongue, the section of chain is withdrawn from the cavity 27 as the piece of fabric is advanced by the thrust of the feed dog 15. In this way the section of chain is completely incorporated into and stretched out in the new stitching produced in the piece of fabric. As soon as the leading edge 33 passes over the end 14 of the tongue the operator removes the pressure from the push button 34, thus restoring the connection between the vacuum unit 29 and the chain cutting device 18.

To do this, the operator does not have to take special care as it is sufficient to produce a few stitches on the sewing machine for the chain section to be completely incorporated in the stitching being produced.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A device for retaining a chain of stitches during commencement of stitching in a sewing machine of the type having a cutting device for severing the chain of stitches connecting one workpiece with another and a feed dog operatively associated with a needle plate for advancing a workpiece to the stitch forming instrumentalities, said device comprising:

a. a tongue (13) forming an integral part of the needle plate on which a chain of stitches is formed having an internal bore (26) extending longitudinally through said tongue and needle plate;

b. vacuum means (29) pneumatically connected to one end of said internal bore; and c. control means (34) for selectively activating said vacuum means for drawing a chain of stitches severed by the cutting device into the internal bore of said tongue and into alignment for incorporation in the stitches to be formed in the next workpiece.

2. The device according to claim 1 wherein said control means includes a switching valve (24) interconnecting said internal bore (26) and cutting device with said vacuum means.

* * * * *